United States Patent [19]

Dempsey et al.

[11] Patent Number: 4,755,400

[45] Date of Patent: Jul. 5, 1988

[54] HOT ROLL FUSER AND METHOD OF MAKING A FUSER ROLL

[75] Inventors: Lawrence P. Dempsey, Longmont; Dean S. Ehn, Boulder; Reid W. Gunnell, Berthoud, all of Colo.; Bruce P. Reinhardt, Minnetonka, Minn.; Lance A. Walker, Longmont, Colo.

[73] Assignee: International Business Machines Corporation, Armonk, N.Y.

[21] Appl. No.: 27,701

[22] Filed: Mar. 19, 1987

[51] Int. Cl.[4] ..... B05D 3/02

[52] U.S. Cl. ..... 427/318; 427/355; 427/409

[58] Field of Search ..... 427/355, 366, 388.2, 427/409, 407.1, 318

[56] References Cited

U.S. PATENT DOCUMENTS

| | | | |
|---|---|---|---|
| 3,765,924 | 10/1973 | Craven | 427/355 X |
| 3,776,760 | 12/1973 | Baker et al. | 117/72 |
| 3,810,776 | 5/1974 | Banks | 427/366 X |
| 3,852,861 | 12/1974 | Baker et al. | 29/132 |
| 3,940,518 | 2/1976 | Bowler, Jr. et al. | 427/379 |
| 3,971,115 | 7/1976 | Schneider et al. | 29/148.4 D |
| 4,145,181 | 3/1979 | Edwards et al. | 432/60 |
| 4,207,059 | 6/1980 | Gaitten et al. | 432/60 |
| 4,258,089 | 3/1981 | Anderson et al. | 427/366 X |
| 4,284,668 | 8/1981 | Nixon | 427/355 |
| 4,435,839 | 3/1984 | Gu et al. | 427/355 X |

FOREIGN PATENT DOCUMENTS 0004411 of 1897 United Kingdom .

*Primary Examiner*—Thurman K. Page
*Attorney, Agent, or Firm*—Francis A. Sirr

[57] ABSTRACT

An electrophotographic fuser roll includes a hard external surface having low surface energy and high abrasion resistance. This surface is formed by sequentially coating a metal roll with two layers of a polymeric material. The polymeric material is not cured until after the second layer is applied. Once the material is cured, it is subjected to a polishing step that also generates heats. In this way, the roll's surface is both polished and heat treated.

27 Claims, 1 Drawing Sheet

HOT ROLL FUSER AND METHOD OF MAKING A FUSER ROLL

DESCRIPTION

1. Field of the Invention

This invention relates to electrophotography, and to the electrophotographic process step of fusing a toner image to a substrate member as the member passes through a pressure nip that is formed by the pressure engagement of two rolls.

2. Background of the Invention

Electrophotographic reproduction involves a number of well known process steps by which a colored toner image is permanently fixed to the surface of a thin substrate medium. For example, black polymeric toner powder is fixed to the surface of a sheet of white bond paper. This toner image may be formed by either a copier or a printer process.

A well known method of fusing a toner image comprises passing the paper sheet through a pressure nip that is formed by pressure engagement of a pair of circular cylinder rolls or rollers. When this pressure nip does not include the application of heat, the device is called a cold pressure roll fuser. When the pressure nip includes the application of heat, the devices is called a hot pressure roll fuser.

Two general types of hot roll fusers exist. One type includes the application of a release material, such as silicone oil, to at least the roll that directly engages the toner. This toner engaging roll is usually the heated roll of the roll pair, and its surface may be either hard or soft. The second type of hot roll fuser is characterized as a dry release fuser in that release material is not applied to either roll.

Pressure fusers use both rigid and soft rolls. For example, the heated roll may be covered with a soft elastomer, whereas the mating roll, called the backup roll, may be covered with a hard fluoropolymer material having low surface energy, for example materials based upon polytetrafluoroethylene (PTFE), perfluoroalkoxy (PFA) or fluorinated ethylene propylene (FEP) copolymer fluorocarbon resins, of which the brand TEFLON is an example.

As an example, U.S. Pat. No. 4,207,059 discloses a hot roll fuser having a hard surface backup roll that is covered with a coating of a fluoropolymer material.

Two of the major failure modes of fuser rolls are the accumulation of a toner film on the roll's surface, and the gradual wearing away of the roll's external surface coating.

When the prior art has attempted to provide rolls of superior wear and long roll life, this was usually accomplished by the use of a higher surface energy coating, having a propensity to toner film. This frequently results in an increase in the number of sheet jams that occur as the sheet fails to release from the roll's surface.

When prior art practitioners sought to provide low surface energy rolls, and thus less toner filming and sheet jamming, a shorter roll life resulted in that a relatively soft coating was used, and it rapidly wore away.

The use of a tetrafluoroethylene type material in a roll fuser is taught by U.S. Pat. Nos. 3,776,760, 3,852,861 and 3,940,518 for example. These patents teach a method of making such a roll, where the roll's external coating consists of a number of individual coatings, each of which is heated to flash off water and solvent. After all individual coatings have been applied, the roll is heated at a higher temperature in order to fuse the thus formed multi-layer tetrafluoroethylene coating.

In the art of making chemically resistant and wear resistant rollers generally, U.S. Pat. No. 3,971,115 teaches the production of a roller having a surface coating of a thermoplastic. This coating is a hard polyvinyl chloride, crystalline polyamide, polypropylene, polyethylene or their combination. After the coated roll of this patent is formed, the outer surface is machined, as by turning or grinding. The roll can thereafter be further improved by chemical smoothing operations, such as by the application of a solvent to the surface to be smoothed, or by thermal smoothing operations, such as by utilizing frictional heat between the smoothing tool and the surface to be smoothed. The roll is stated to be useful in a developing apparatus which is used to develop photographic strip or sheet materials.

Hard, wear resistant, polished rollers are of course well known, as is exemplified by United Kingdom Patent No. 4411, wherein a roller made of woven cloth, felt, paper, wood pulp, asbestos, and the like materials, is impregnated with liquid celluloid, and then given a fine polish.

The foregoing and other features and advantages of the invention will be apparent from the following more particular description of preferred embodiments of the invention, as illustrated in the accompanying drawing.

Figure 1:
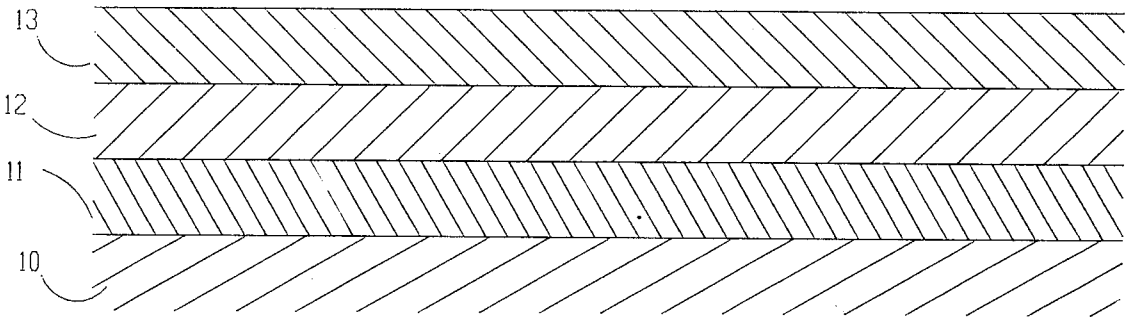
FIG. 1 is a schematic showing of the layered construction of a fuser roll in accordance with a comparative example I.

The dimensions shown in the figures are not intended to represent actual relative dimensions.

SUMMARY OF THE INVENTION

An object of this invention is to provide a fuser roll having long roll life (i.e., a coating of improved hardness and abrasion resistance) and a low surface energy surface.

As used herein, the term fuser roll is intended to mean either the roll that directly engages the toner image being fused, or the roll that forms a pressure nip with that roll. In addition, as the term fuser roll is used herein it can mean either a heated roll or an unheated roll.

A fuser roll made in accordance with the present invention is more resistant to toner contamination, less sheet jamming occurs, and its fusing surface is more resistant to abrasion.

The present invention relates to an improved fuser roll, and to an improved method of making a low surface energy, long life, hard fuser roll.

The present invention (see FIG. 2) forms such a hard roll by coating a metal core 10 with at least one coating 16 of a fluorinated polymer. This coating(s) is then dried, but the polymer is not cured or fused. After the final coating 15 of polymer is applied, the roll is heated to a temperature that fuses all layers (15 and 16 in FIG. 2) of the polymer. The manner in which layers 16 and 15 are deposited is sometimes called multi-pass coating.

After the polymer has been fused, the roll's polymer surface 17 is polished by a means that not only polishes its surface, but also generates sufficient heat to increase the surface's hardness and lowers its surface energy.

For example, the roll's surface 17 is polished using a high speed buffer or polisher.

The combination of (1) the step of applying multiple polymer layers (15 and 16), with the curing of all layers awaiting application of the final layer, and (2) the step of polishing the roll using a means that also generates sufficient heat, produces, in a manner presently unknown, a roll whose fusing surface 17 has both superior wear properties and low surface energy.

THE INVENTION

While preferred embodiments of the present invention will be described with reference to a hard surface backup roll for use in a hot roll fuser (i.e., the unheated roll that forms a fusing nip with the resilient surface of a heated roll), the scope of the present invention is not to be limited thereto, since the roll of the present invention has utility, for example as the hot roll of a hot roll fuser, or as the roll(s) of a cold pressure roll fuser.

The present invention will be described using a brand of polytetrafluoroethylene (PTFE) fluorocarbon and fluorinated ethylene propylene (FEP) copolymers known by the brand name SILVERSTONE, a product of the E. I. DuPont de Nemours & Company. However, the scope of the present invention is not to be restricted to the use of this specific material or this specific brand. Rather, the present invention relates to the use of any such fluoropolymer.

A hot roll fuser of the type in which the roll of the present invention may be used is disclosed in aforementioned U.S. Pat. No. 4,207,059, and in U.S. Pat. No. 4,145,181, both of which are incorporated herein by reference.

A roll in accordance with the present invention includes a generally hollow (i.e., a centrally located hub, and radially extending ribs may be used), metal, circular cylinder inner core 10, for example a hollow aluminum tube having a wall thickness of about 5/16 inch, about 3 inches in diameter and about 15 inches long. Metal rotational journal members are pressed into the ends of this aluminum tube. The assembly is then stress relieved by placing it in an oven and heating the assembly for about 3 hours at a temperature of about 620° F.

The inner core's outer surface is then precision ground to the desired diameter, thereby forming an assembly that is concentric with its two end journal members.

The inner core is now washed in a detergent to remove contamination, and then air dried at ambient room temperature. As a final step in the metal core's preparation to receive a coating, its surface is grit blasted to a surface roughness of from 180 to 220 microinches. This step roughens the core's surface so that the subsequently applied polymer primer coat will adhere to the core's surface in a satisfactory manner.

The core's cylindrical exterior surface is now coated to a thickness of from 0.0003 to 0.0005 inch with a coating 11 of SILVERSTONE #459-516 primer. For example, the core is spray coated as the core rotates with its axis in a vertical position. This primer coat is then air dried at ambient room temperature.

The #459-516 primer material comprises fluoropolymer solids, oxygenated nitrogen polymer, octylphyenoxypolyethyoxyethanol nonionic surfactant, diethylaminoethanol solvent, furfuryl alcohol solvent, N-methyl-2-pyrolidone solvent, amorphous silica, mica and titanium dioxide.

The function of primer coating 11 is provide adequate adhesion between the the metal core and intermediate layer 12, which is the layer next to be applied.

After the primer coat has been dried, the core is spray coated to a thickness of from 0.0004 to 0.0006 inch with an intermediate fluoropolymer coating 12 of SILVERSTONE intermediate material #456-236.

This intermediate material #456-236 comprises fluoropolymer solids, mica, 2-(2-butoxy ethoxy) ethanol, triethanolamine, an aromatic hydrocarbon solvent, octylphenoxypolyethoxyethanol nonionic surfactant, and titanium dioxide.

The function of intermediate coating 12 is much like that of primer coat 11.

While the #456-236 coating is still wet, the roll is coated to a thickness of from 0.0004 to 0.0006 inch with a first layer 16 of SILVERSTONE #456-300.

Topcoat material #456-300 is substantially identical to intermediate material #456-236, but has a higher concentration of fluoropolymer. More specifically, the −236 material contains about 50% fluoropolymer, whereas the −300 material contains about 90% fluoropolymer. The −236 material comprises fluoropolymer solids, mica, 2-(2-butoxy ethoxy) ethanol solvent, triethanolamine, an aromatic hyrdocarbon solvent, octylphenoxypolyethoxyethanol nonionic surfactant, and titanium dioxide.

The roll is now subjected to a higher temperature oven, but only for a short period of time. This step drives off the coating's volatiles, but does not fuse or cure coating 16. More specifically, the roll is placed in a conveyor oven having a temperature setting of 800° F. for a period of from 15 to 25 minutes.

The roll is allowed to cool, and is thereafter coated with a second coating 15 of SILVERSTONE #456-300, again to a thickness of about 0.0004 to 0.0006 inch. As will be demonstrated, the use of this second coating is critical to the present invention.

The roll is now placed in a conveyor oven set at 800° F., for a time period of from 40 to 50 minutes. This step fuses and cures all coatings.

After the roll has cooled, its surface 17 (i.e., the exposed surface of layer 15) is manually wet sanded, using a two-step procedure.

The first wet sanding step is for about 30 seconds, manually using a 600-grit sanding paper. The second step comprises manually wet sanding for 1 to 2 minutes, using European grade 1000-P grit paper. Both of these wet sanding steps occur as the roll is rotated at about 575 revolutions per minute (rpm). The manual pressure used for these two wet sanding steps is about 25 to 27 pounds per square inch (psi). This operation removes undesirable high spots.

While a speed of 575 rpm's was used, as above stated, it is more important to understand that for a roll having about a 3-inch diameter, this comprises about 462 surface feet per minute.

The next step in the process is also critical to the present invention. In this step the roll's surface 17 is polished and heat treated with a non-woven talc cloth, to give a surface finish of less than 25 microinches, and to close any porous surface areas of the roll. More specifically, the roll's surface 17 is polished for 1 minute, with the talc cloth while the roll is rotated at a speed of about 575 rpm, while the cloth is moved back and forth across the spinning roll's surface. This operation includes the step of loading the talc cloth against the roll's surface with force of about 25 to 27 pounds per square inch.

Using the described talc cloth, the above noted parameters of roll speed and pressure force ensure that sufficient heat is generated to increase the hardness of surface 17, and to lower this surface's surface energy.

In accordance with the present invention, this polish/heat step must generate sufficient heat to increase the roll's surface hardness, and to lower the roll's surface energy.

In order to demonstrate the fact that the above stated two critical steps are, in fact, critical to the present invention, two comparative example rolls and one invention example roll were prepared. These rolls were prepared using the same method of production for all rolls, with the exception that a variation in the use of said two critical steps occurred in the making of the two comparative examples. All three rolls had the same final total coating thickness of about 0.0019 inch (i.e, the thickness of layers 11, 12 and 13 of FIG. 1, and the thickness of layers 11, 12 and 14 of FIG. 2).

Figure 2:
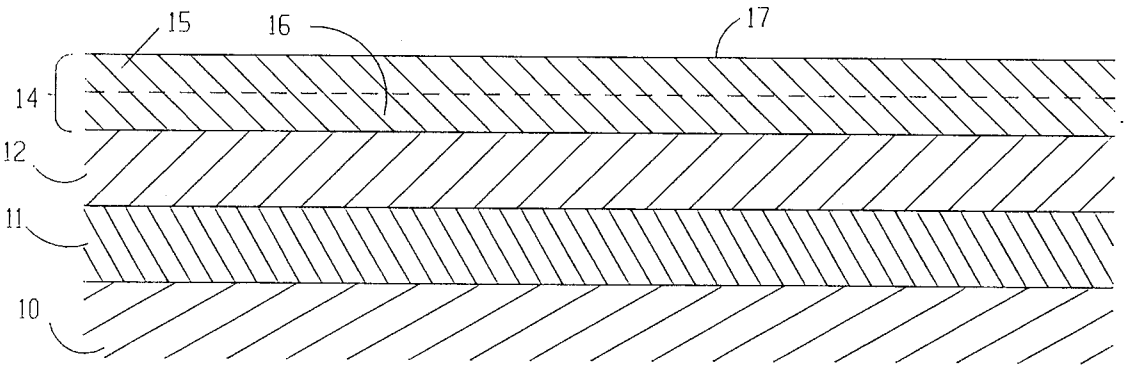
FIG. 2 is a schematic showing of the layered construction of a fuser roll in accordance with a comparative example II and an invention example.

FIG. 1 shows Comparative Example I; whereas, FIG. 2 shows both Comparative Example II and the Invention Example. As will be apparent, Comparative Example II and the Invention Example differ only in the manner in which the roll's outer surface was polished, and this feature does not appear in a schematic showing of these two rolls.

Comparative Example Roll I is shown schematically in FIG. 1. This roll included the metal inner core 10, the primer layer 11, the intermediate layer 12, and a single top coating layer 13. Layer 13 was subjected to the present invention's critical polish/heat step.

Comparative Example Roll II is shown schematically in FIG. 2. This roll included the metal inner core 10, the primer layer 11, the intermediate layer 12, and the top coating layer 14, having individual layers 15 and 16. Layer 14 was made using the present invention's critical step of applying the second polymer coating layer 15 to an uncured first polymer coating layer 16, but the polishing step did not include the generation of heat.

More specifically, in the making of Comparative Example Roll I, coating 13 was formed as a single layer, i.e., layer 13 was made without using a critical step of the present invention; however, layer 13 was polished in a manner of the present invention that included the generation of heat. In the making of Comparative Example Roll II, the roll's layer 14 was formed in accordance with a critical step of the present invention, but the roll was cooled by the application of water during the polishing step in order to prevent the generation of heat.

Thus, Comparative Example I included only one critical feature of the present invention, and Comparative Example II included only the other critical feature of the present invention.

The Invention Example roll is shown schematically in FIG. 2. This roll included the metal inner core 10, the primer layer 11, the intermediate layer 12, and the top coating layer 14, having individual layers 15 and 16. Layer 14 was made using the present invention's critical step of applying the second polymer coating layer 15 to an uncured first polymer coating layer 16, and the polishing step included the generation of heat.

In tabular form these three rolls can be represented as follows:

| | |
|---|---|
| Comparative Example Roll I | single layer 13<br>polish/heat layer 13 |
| Comparative Example Roll II | double layer 14<br>polish only layer 14 |
| Invention Example | double layer 14<br>polish/heat layer 14 |

In order to show that these three finished rolls had essentially the same surface texture, the surface texture of each roll was measured using the brand Taylor-Hobson 5-120 surface profilometer. The results of this measurement were as follows:

Comparative Example Roll I=19.4 microinches
Comparative Example Roll II=17.5 microinches
Invention Example=16.0 microinches The above measurements show that the differences in surface energy and abrasion resistance, to be discussed below, are not as a result of a materially different surface texture.

The surface energy, and thus the propensity of toner to stick to the roll's surface, was then measured by the well known and accepted method of measuring the contact angle of a water drop that was placed on a horizontal surface of the roll. The following results were noted:

Comparative Example Roll I=106°
Comparative Example Roll II=102°
Invention Example=115°

The above measurements show that the surface energy of the Invention Example is surprisingly less than either of the comparative example rolls.

The abrasion resistance, and thus the life of each roll was then tested using the ASTM test method D 968-51 (Reapproved 1966), wherein sand is poured over the roll until the coating wore away to core 10. The following results were noted: Comparative Example Roll I=113 liters of sand Comparative Example Roll II=183 liters of sand Invention Example=253 liters of sand The above measurements show that the invention example roll is surprisingly more resistant to wear than either of the comparative example rolls.

As those skilled in the art will appreciate, the present invention provides a fuser roll having both high abrasion resistance and low surface energy. Thus, the roll of this invention will experience longer life as a fuser roll, and the roll will exhibit less tendency to film with toner and the like, the result being less sheet jams as sheets exit the pressure fusing nip.

The above unexpected results flow from the combination of the method steps of (1) applying multiple polymer layers, but fusing the layers only after all layers have been applied, and (2) polishing the roll's surface in a manner that also generates heat, i.e., the roll's surface is heat treated as the surface is polished.

While this invention has been particularly described with reference to a preferred embodiment thereof, it will be understood by those skilled in the art that various changes in detail may be made therein without departing from the spirit and scope of this invention.

What is claimed is:

1. A method of manufacturing a polymer coated electrophotographic fuser roll comprising the sequential steps of:

applying primer coat means (11 and 12) to a cylindrical metal roll (10), applying a first coat (16) of a fluoropolymer to said primer coat means, heating, without curing, said first fluoropolymer coat, applying a second coat (15) of a fluoropolymer to said first fluoropolymer coat, curing said first and second fluoropolymer coatings at an elevated temperature, and polishing the exposed surface (17) of said second fluoropolymer coat in a manner that generates sufficient heat to increase the hardness and to lower the surface energy of said coated roll in the absence of additional coats.

2. The method of claim 1 wherein said first and second coats are formed of the same material.

3. The method of claim 2 wherein said primer coat means in from 0.0007 to 0.0011 inch thick, and each of said first and second fluoropolymer coats are from 0.0004 to 0.0006 inch thick.

4. The method of claim 2 wherein said primer coat means includes a primer coat (11) that is applied directly to said metal roll, and an intermediate polymer coat (12) that is applied to said primer coat.

5. The method of claim 4 wherein said intermediate coat (12) comprises substantially the same material as said first and second fluoropolymer coats.

6. The method of claim 5 wherein said primer coat is from 0.0003 to 0.0005 inch thick, said intermediate coat is from 0.0004 to 0.0006 inch thick, and each of said first and second fluoropolymer coats are from 0.0004 to 0.0006 inch thick.

7. The method of claim 1 including the step of preparing said metal roll for the application of said primer coat means by producing a roughness of from 180 to 220 microinches on the surface of said metal roll prior to the application of said primer coat means.

8. The method of claim 7 including the step of stress relieving said metal roll by the application of heat prior to the application of said primer coat means.

9. The method of claim 8 wherein said first and second coats comprise the same polymeric material.

10. The method of claim 9 wherein said primer coat means is from 0.0007 to 0.0011 inch thick, and each of said first and second fluoropolymer coats are from 0.0004 to 0.0006 inch thick.

11. The method of claim 9 wherein said primer coat means includes a primer coat (11) that is applied directly to said metal roll, and an intermediate polymer coat (12) that is applied to said primer coat.

12. The method of claim 11 wherein said intermediate coat comprises a fluoropolymer.

13. The method of claim 12 wherein said primer coat is from 0.0003 to 0.0005 inch thick, said intermediate coat is from 0.0004 to 0.0006 inch thick, and each of said first and second fluoropolymer coats are from 0.0004 to 0.0006 inch thick.

14. The method of claim 1 wherein said polishing step comprises polishing said exposed surface with a non-woven talc cloth while exerting a force thereagainst of about 26 pounds per square inch.

15. The method of claim 14 wherein said polishing step includes the step of rotating said roll to achieve a surface speed of about 462 feet per minute as said talc cloth is moved back and forth across the surface of said roll.

16. The method of claim 15 wherein said polishing step achieves a surface finish of less than about 25 microinches.

17. The method of claim 16 including the step of preparing said metal roll for the application of said primer coat means by producing a roughness of from 180 to 220 microinches on the surface of said metal roll prior to the application of said primer coat means.

18. The method of claim 17 including the step of stress relieving said metal roll by the application of heat prior to the application of said primer coat means.

19. The method of claim 18 wherein said first and second coats comprise the same polymeric material.

20. The method of claim 19 wherein said primer coat means is from 0.0007 to 0.0011 inch thick, and each of said first and second fluoropolymer coats are from 0.0004 to 0.0006 inch thick.

21. The method of claim 20 wherein said primer coat means includes a primer coat (11) that is applied directly to said metal roll, and an intermediate polymer coat (12) that is applied to said primer coat.

22. The method of claim 21 wherein intermediate coat comprises a fluoropolymer.

23. The method of claim 22 wherein said primer coat is from 0.0003 to 0.0005 inch thick, said intermediate coat is from 0.0004 to 0.0006 inch thick.

24. The method of claim 14 wherein prior to said polishing step, said surface is subjected to a wet sanding step.

25. The method of claim 24 wherein said wet sanding step comprises an initial step of wet sanding with a low grit paper for about 30 seconds, followed by wet sanding with a higher grid paper for about 2 minutes.

26. The method of claim 25 wherein said wet sanding steps include the application of a force of about 26 pounds per square inch.

27. The method of claim 26 wherein said polishing step and said sanding step are accompanied by rotation of said roll at a surface speed of about 462 feet per minute.

* * * * *